US005372344A

United States Patent [19]

Syvuk

[11] Patent Number: 5,372,344

[45] Date of Patent: Dec. 13, 1994

[54] SYSTEM FOR DISPLAYING OBJECTS

[75] Inventor: Max E. Syvuk, Middleburg Heights, Ohio

[73] Assignee: American Greetings Corporation, Cleveland, Ohio

[21] Appl. No.: 93,084

[22] Filed: Jul. 16, 1993

[51] Int. Cl.[5] ..... A47B 96/06

[52] U.S. Cl. ..... 248/225.1; 248/220.2

[58] Field of Search ..... 248/220.2, 225.1, 225.2, 248/224.2, 224.3, 224.4; 211/94, 87, 192; 52/36

[56] References Cited

U.S. PATENT DOCUMENTS

| | | | |
|---|---|---|---|
| 1,504,523 | 8/1924 | Sherer . | |
| 1,739,057 | 12/1929 | Bock . | |
| 1,807,356 | 5/1931 | Vance . | |
| 2,553,960 | 5/1951 | Swart . | |
| 3,515,284 | 6/1970 | Taylor . | |
| 3,698,565 | 10/1972 | Weber . | |
| 4,026,508 | 5/1977 | Ziegler . | |
| 4,211,379 | 7/1980 | Morgan et al. . | |
| 4,215,840 | 8/1980 | Babberl . | |
| 4,311,295 | 1/1982 | Jamar, Jr. . | |
| 4,508,231 | 4/1985 | Honickman . | |
| 4,591,058 | 5/1986 | Amstutz et al. . | |
| 4,607,753 | 8/1986 | Radek . | |
| 4,678,151 | 7/1987 | Radek | 248/220.2 |
| 4,679,368 | 7/1987 | Pettinga | 52/36 |
| 4,694,965 | 9/1987 | Parnell . | |
| 4,726,554 | 2/1988 | Sorrell . | |
| 4,817,900 | 4/1989 | Whittington | 248/224.4 X |
| 4,830,203 | 5/1989 | Ennis | 248/225.1 X |
| 4,869,378 | 9/1989 | Miller | 211/94 |
| 4,871,135 | 10/1989 | Thalenfeld . | |
| 4,882,868 | 11/1989 | Fast . | |
| 4,909,464 | 3/1990 | Levine et al. . | |
| 4,932,538 | 6/1990 | Gambello | 211/87 |
| 4,976,357 | 12/1990 | Pearson | 248/225.1 X |

FOREIGN PATENT DOCUMENTS

| | | | |
|---|---|---|---|
| 48225 | 3/1982 | European Pat. Off. | 248/225.1 |
| 2450582 | 10/1980 | France . | |

*Primary Examiner*—J. Franklin Foss

*Attorney, Agent, or Firm*—Calfee, Halter & Griswold

[57] ABSTRACT

A system for displaying objects which comprises a panel having horizontal channels therein and a clip which may be interlocked within one of the channels is provided. The panel includes a base. At evenly spaced intervals along the base, a plurality of flanges project forwardly from the base and lie in a plane which is perpendicular to the plane of the base. Each adjacent pair of the flanges forms one of the channels within which the clip may be interlocked. A plurality of slats are connected to the flanges and lie in a plane which is perpendicular to the plane of the flanges and parallel to the plane of the base. Each slat is connected to a different one of the flanges such that each slat has a corresponding flange. Further, each slat has an upper portion and a lower portion. Intermediate each adjacent pair of the flanges, there is a raised portion. Each raised portion has a flat front surface. The clip includes a base portion and a clip member projecting forwardly from a front surface of the base portion. The base portion has a flat rear surface. When the clip is interlocked within one of the channels, the rear surface of the base portion of the clip lies in uniform contact with the front surface of the raised portion of the panel.

9 Claims, 3 Drawing Sheets

SYSTEM FOR DISPLAYING OBJECTS

FIELD OF THE INVENTION

The present invention relates generally to a system for displaying objects. More particularly, the present invention relates to a system for displaying objects which comprises a panel having horizontal channels therein and a clip which may be interlocked within one of the channels.

BACKGROUND OF THE INVENTION

A variety of systems for displaying objects in retail environments are known in the art. With particular relevance to the display system of the present invention, systems for displaying objects which comprise panels and interengaging fixtures or hooks are known in the art.

For example, U.S. Pat. No. 4,211,379 to Morgan et al. ("Morgan") discloses a panel board and mounting fixture combination. The Morgan panel board has regularly spaced lateral grooves with an undercut. In Morgan, the fixture is mounted on the panel board by a manual insertion, involving the positioning of the uppermost free end of the fixture into an associated groove, and thereafter downwardly rotating the fixture until the lower portion thereof engages a similar groove.

Additionally, U.S. Pat. No. 4,726,554 to Sorrell ("Sorrell") discloses a system for mounting hooks on display boards comprising a special board member and a special hook member. The Sorrell board member has at least one horizontal channel of special configuration such that the special hook member can be placed in interengagement with the channel.

All of the known display systems have shortcomings. Some display systems require a minimal tolerance between the interengaging portions of the system. If the interengaging portions do not fall within the required tolerance, a secure fit may not be obtained between such interengaging portions. Other display systems have a more complicated construction and thus are more expensive to produce and may be difficult to use. Therefore, it is believed that a need exists to provide a system for displaying objects which has a simple construction, is easy to use, and provides a secure fit.

SUMMARY OF THE INVENTION

Generally, the present invention provides a system for displaying objects which has a simple construction, is easy to use, and provides a secure fit. More particularly, the present invention provides a system for displaying objects which comprises a panel having horizontal channels therein and a clip which may be interlocked within one of the channels.

The panel includes a base. At evenly spaced intervals along the base, a plurality of flanges project forwardly from the base and lie in a plane which is perpendicular to the plane of the base. Each adjacent pair of the flanges forms one of the channels within which the clip may be interlocked. A plurality of slats are connected to the flanges and lie in a plane which is perpendicular to the plane of the flanges and parallel to the plane of the base. Each slat is connected to a different one of the flanges such that each slat has a corresponding flange. Intermediate each adjacent pair of the flanges, there is a raised portion. Each raised portion has a flat front surface.

The clip includes a base portion and a clip member projecting forwardly from a front surface of the base portion. The base portion has a flat rear surface. When the clip is interlocked within one of the channels, the rear surface of the base portion of the clip lies in uniform contact with the front surface of the raised portion of the panel.

These and other features of the present invention are fully described and particularly pointed out in the claims. The following detailed description and accompanying drawings set forth in detail an illustrative embodiment. However, this embodiment is indicative of but one of the various ways in which the principles of the present invention may be employed.

DETAILED DESCRIPTION OF THE PREFERRED EMBODIMENT

Figure 1:
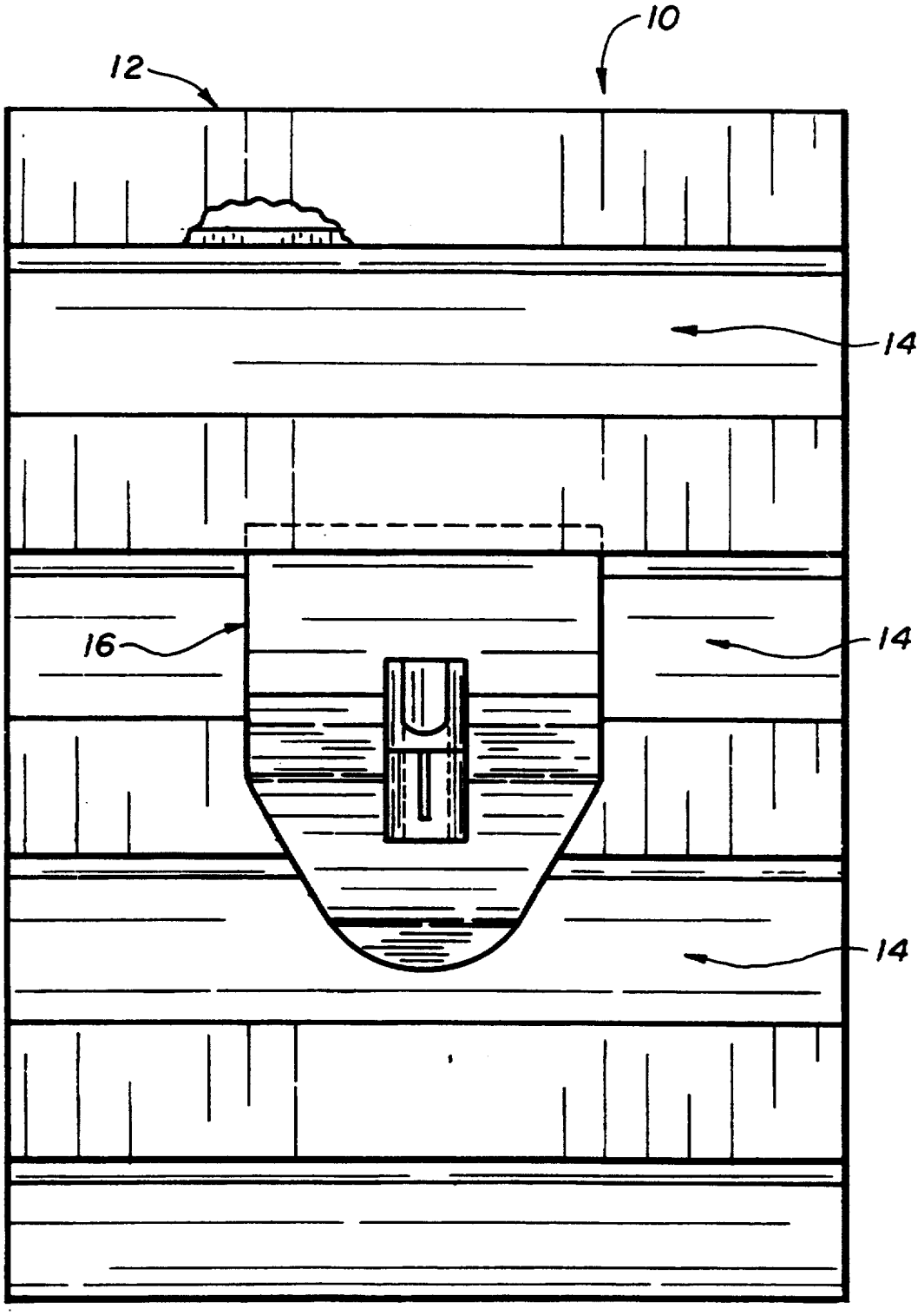
FIG. 1 is a front view of a display system constructed according to the principles of the present invention.

Referring to the drawings, FIG. 1 is a front view of a display system 10 constructed according to the principles of the present invention. The display system 10 comprises a panel 12 having horizontal channels 14 therein and a clip 16 which may be interlocked within one of the channels 14. The panel 12 has a rectangular shape in the illustrated embodiment, but could have any desired shape and size. The panel 12 may be attached to a wall surface or may be used to form a free-standing display. Toward this end, a single panel may be used or a plurality of panels may be combined to form a desired display. Further, any number of clips 16 may be used in connection with the panel 12.

Figure 2:
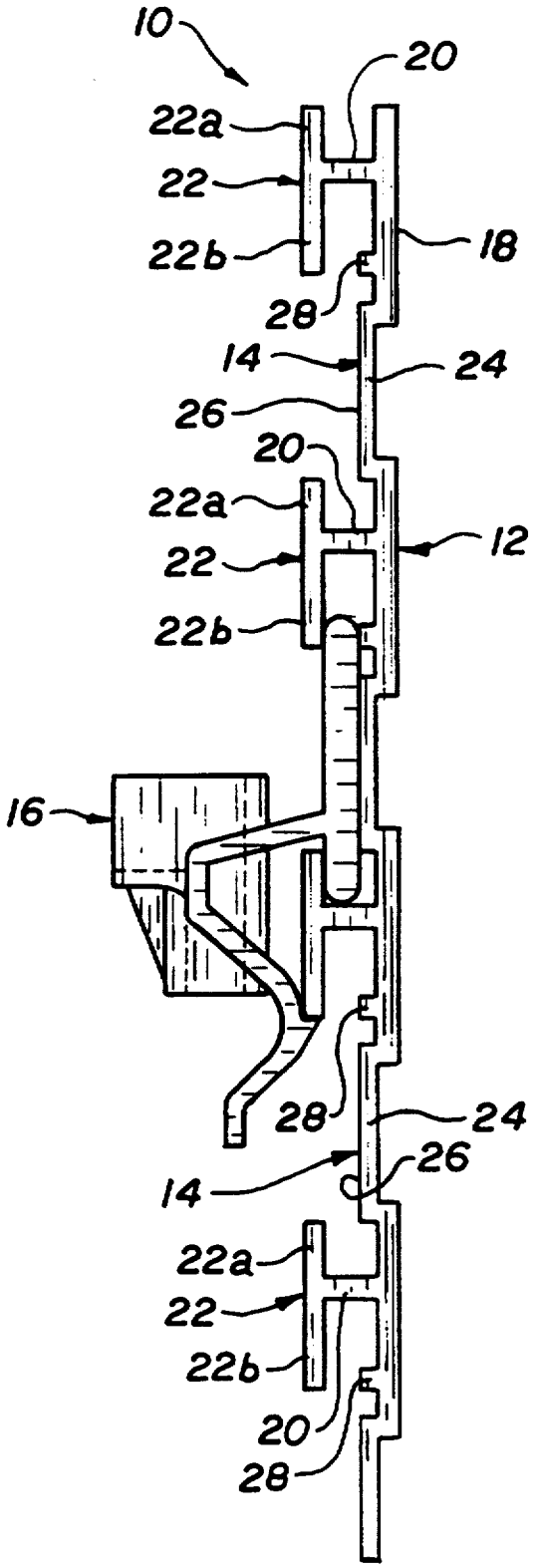
FIG. 2 is a side view of the display system of FIG. 1.

The structure of the panel 12 is best described with reference to the side view of the display system 10 shown in FIG. 2. In the preferred embodiment, the panel 12 is extruded as an integral piece from a high impact polystyrene ("HIPS"). The panel 12 includes a base 18. At evenly spaced intervals along the base 18, a plurality of flanges 20 project forwardly from the base 18 and lie in a plane which is perpendicular to the plane of the base 18. Each adjacent pair of the flanges 20 forms one of the channels 14 within which the clip 16 may be interlocked. A plurality of slats 22 are connected to the flanges 20 and lie in a plane which is perpendicular to the plane of the flanges 20 and parallel to the plane of the base 18. Each slat 22 is connected to a different one of the flanges 20 such that each slat 22 has a corresponding flange 20. Each corresponding flange 20 and slat 22 form a "T" shape which projects forwardly from the base 18. Further, each slat 22 has an upper portion 22*a* and a lower portion 22*b*. In the preferred embodiment, the upper portion 22*a* and the lower portion 22*b* of each slat 22 are spaced an equal distance from the base 18. Intermediate each adjacent pair of the flanges 20, there is a raised portion 24. Each raised portion 24 has a flat front surface 26. A ridge 28 is spaced above each raised portion 24.

Figure 3:
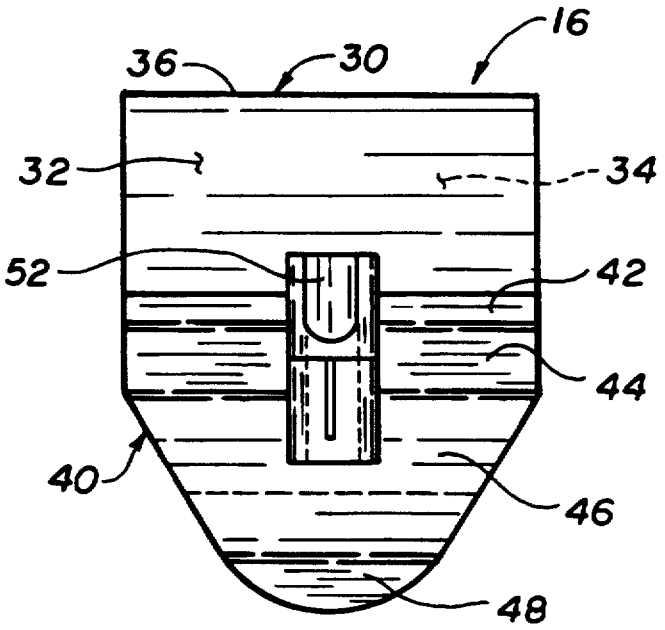
FIG. 3 is a front view of a clip used in the display system of FIG. 1.
Figure 4:
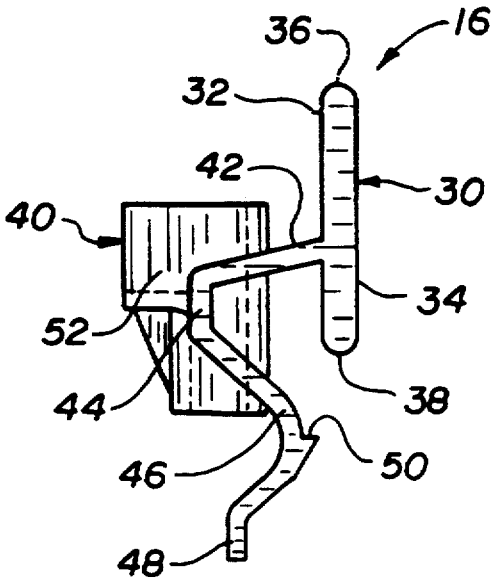
FIG. 4 is a side view of a clip used in the display system of FIG. 1.

Referring now to FIGS. 3 and 4, a front view and a side view, respectively, of the clip 16 used in the display system 10 are shown. In the preferred embodiment, the clip 16 is molded as an integral piece from an acetal resin. One suitable acetal resin is commercially available under the trademark Delrin 500F from E. I. Du Pont de Nemours & Co. of Wilmington, Del. 19898. The clip 16 includes a rectangular base portion 30 having a front surface 32, a rear surface 34, a top edge 36, and a bottom edge 38. A clip member 40 projects forwardly from the front surface 32 of the base portion 30 near the bottom edge 38 thereof. The clip member 40 comprises a top portion 42, an intermediate portion 44, a curved portion 46, and a bottom portion 48. The top portion 42 projects forwardly from the base portion 30 and is angled slightly downwardly from a horizontal plane. The intermediate portion 44 and the bottom portion 48 lie in a plane which is parallel to the plane of the base portion 30. The curved portion 46 connects the intermediate portion 44 and the bottom portion 48 and curves rearwardly toward the base portion 30. A shelf 50 projects rearwardly from the curved portion 46. Further, a sleeve 52 is formed in the top portion 42, the intermediate portion 44, and the curved portion 46 of the clip member 40.

In order to interlock the clip 16 within one of the channels 14, the top edge 36 of the base portion 30 is inserted behind the upper slat 22 of any adjacent pair of the slats 22. When the top edge 36 contacts the flange 20 associated with the upper slat 22, the clip 16 is moved rearwardly toward the base 18 of the panel 12 until the rear surface 34 of the base portion 30 comes into uniform contact with the front surface 26 of the raised portion 24. This uniform contact will enable a secure fit to be obtained between the clip 16 and the panel 12. Next, the clip 16 is moved downwardly until the bottom edge 38 of the base portion 30 contacts the flange 20 associated with the lower slat 22 and the shelf 50 snaps below the lower slat 22. At this point, the clip 16 is interlocked within the channel 14 and may be used to display objects. Further to this purpose, an object may be inserted directly into the sleeve 52 or a metal hook may be inserted into the sleeve 52 and the object hung from the metal hook.

One may now appreciate that the present invention provides a system for displaying objects which has a simple construction, is easy to use, and provides a secure fit. Although the present invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A system for displaying objects, comprising:

a panel, said panel including a base; a plurality of flanges which project forwardly from said base at evenly spaced intervals along said base and lie in respective planes which are perpendicular to the plane of said base, each adjacent pair of said flanges forming a channel; a plurality of slats which are connected to said flanges and lie in a plane which is perpendicular to the planes of said flanges and parallel to the plane of said base, each slat being connected to a different one of said flanges such that each slat has a corresponding flange, each slat having an upper portion and a lower portion; and a plurality of raised portions intermediate each adjacent pair of said flanges, each raised portion having a flat front surface;

a clip, said clip including a base portion and a clip member which projects forwardly from a front surface of said base portion, said base portion having a flat rear surface;

wherein said rear surface of said base portion of said clip lies in uniform contact with said front surface of said raised portion of said panel when said clip is interlocked within said channel.

2. The system of claim 1, wherein said upper portion and said lower portion of each slat are spaced an equal distance from said base.

3. The system of claim 2, wherein said panel is extruded as an integral piece from a high impact polystyrene.

4. The system of claim 1, wherein said clip member comprises a top portion which projects forwardly from said base portion and is angled downwardly from a horizontal plane; an intermediate portion and a bottom portion which lie in a plane which is parallel to the plane of said base portion; and a curved portion which connects said intermediate portion and said bottom portion and curves rearwardly toward said base portion.

5. The system of claim 4, wherein said clip member further comprises a shelf which projects rearwardly from said curved portion of said clip member and snaps below one of said slats when said clip is interlocked within said channel.

6. The system of claim 5, wherein said clip member further comprises a sleeve which is formed in said top portion, said intermediate portion, and said curved portion of said clip member.

7. The system of claim 6, wherein said clip is molded as an integral piece from an acetal resin.

8. The system of claim 7, wherein said acetal resin is Delrin 500F.

9. The system of claim 1, wherein said clip member defines a rearwardly projecting shelf which snaps below one of said slats when said clip is interlocked within said channel.

* * * * *